US010378847B2

(12) United States Patent
Folk et al.

(10) Patent No.: US 10,378,847 B2
(45) Date of Patent: Aug. 13, 2019

(54) FORWARD SET TRIGGER BAR FOR A FIREARM

(71) Applicant: Apex Tactical Specialties, Inc., Peoria, AZ (US)

(72) Inventors: Donald Scott Folk, Litchfield Park, AZ (US); Matthew James Theiss, Glendale, AZ (US)

(73) Assignee: Apex Tactical Specialties, Inc., Peoria, AZ (US)

( * ) Notice: Subject to any disclaimer, the term of this patent is extended or adjusted under 35 U.S.C. 154(b) by 253 days.

(21) Appl. No.: 15/667,626

(22) Filed: Aug. 3, 2017

(65) Prior Publication Data

US 2019/0041151 A1 Feb. 7, 2019

(51) Int. Cl.

| | |
|---|---|
| ***F41A 19/31*** | (2006.01) |
| ***F41A 19/10*** | (2006.01) |
| ***F41A 17/72*** | (2006.01) |

(52) U.S. Cl.

CPC ..... *F41A 19/31* (2013.01); *F41A 17/72* (2013.01); *F41A 19/10* (2013.01)

(58) Field of Classification Search

CPC ..... F41A 19/31; F41A 19/10; F41A 17/56; F41A 19/17; F41A 19/44; F41A 17/20; F41A 17/22; F41A 17/48

USPC ..... 42/69.02, 70.02–70.04, 69.01–69.03

See application file for complete search history.

(56) References Cited

U.S. PATENT DOCUMENTS

| | | | | |
|---|---|---|---|---|
| 4,577,430 | A * | 3/1986 | Ruger | F41A 19/10 42/69.01 |
| 5,402,593 | A * | 4/1995 | Lenkarski | F41A 17/22 42/70.06 |
| 5,906,066 | A * | 5/1999 | Felk | F41A 3/04 42/69.02 |
| 6,308,448 | B1 * | 10/2001 | Kapusta | F41A 19/31 42/69.02 |
| 6,993,864 | B1 * | 2/2006 | O'Clair | F41A 3/14 42/71.02 |
| 7,194,833 | B1 * | 3/2007 | Curry | F41A 19/12 42/14 |
| 7,617,628 | B2 | 11/2009 | Curry | |
| 8,601,932 | B1 * | 12/2013 | Karfiol | F41A 19/12 42/69.02 |
| 9,140,510 | B1 * | 9/2015 | Muska | F41A 19/42 |
| 10,234,225 | B2 * | 3/2019 | Zukowski | F41A 17/20 |
| 2005/0011098 | A1 * | 1/2005 | Fagundes de Campos | F41A 17/72 42/70.04 |
| 2006/0248772 | A1 * | 11/2006 | Curry | F41A 19/12 42/69.02 |
| 2006/0249014 | A1 * | 11/2006 | Curry | F41A 11/00 89/196 |
| 2011/0289811 | A1 * | 12/2011 | Gentilini | F41A 17/72 42/69.02 |

(Continued)

*Primary Examiner* — Joshua E Freeman
*Assistant Examiner* — Bridget A Cochran
(74) *Attorney, Agent, or Firm* — Fitch, Even, Tabin & Flannery LLP

(57) ABSTRACT

A trigger bar for a semi-automatic firearm. The trigger bar includes a longitudinal body with a rearward lateral arm. The arm includes surfaces for engaging the sear and the drop safety lifter of the firearm. The surfaces are configured to reduce trigger pre-travel distances by reducing a trigger travel distance prior to drop safety lifter engagement, sear engagement, and striker release. An over-travel stop reduces a trigger over-travel distance.

20 Claims, 11 Drawing Sheets

(56) References Cited

U.S. PATENT DOCUMENTS

| | | | | |
|---|---|---|---|---|
| 2012/0090213 | A1* | 4/2012 | Pichler | F41A 17/46<br>42/70.06 |
| 2012/0090450 | A1* | 4/2012 | Pichler | F41A 19/12<br>89/4.1 |

* cited by examiner

FORWARD SET TRIGGER BAR FOR A FIREARM

BACKGROUND OF THE INVENTION

Field of the Invention

The present invention relates generally to firearms, and more specifically to firing mechanisms for a firearm.

Discussion of the Related Art

Firearms use triggers to initiate the firing of a cartridge in the firing chamber of the weapon. This is accomplished by actuating a striking device (a striker) through a combination of spring and kinetic energy operating through a firing pin to strike and ignite the primer.

In semi-automatic pistols, rotation of a sear releases the striker, allowing the striker to contact the firing pin. The sear is in turn rotated by the rearward movement of the trigger. The trigger bar connects the trigger to the sear and translates the rearward movement of the trigger into the rotation of the sear that allows striker to be released, resulting in firing of the pistol.

The trigger is generally connected to the trigger bar via a trigger bar pin or boss which allows the trigger to move with the trigger bar and also allows the trigger bar to rotate around the pin/boss axis.

Trigger characteristics may include travel segments such as a pre-travel distance, an engagement distance, an over-travel distance, and a reset distance. The pre-travel distance, also called "take-up", is generally the distance the trigger travels from its forward-most resting position (i.e. the position of the trigger in the absence of a rear-ward pull force) to an engagement point where the first element of the fire control system is engaged. The over-travel distance is the distance the trigger travels rearward between the instant the firing pin is released and the instant that the rearward movement of the trigger is arrested (typically by one or more mechanical stops).

Additionally, while a trigger is traveling these travel segments, trigger pull weights, or forces, are exerted in opposition to the general direction of travel of the trigger (except for a post-firing reset travel, wherein the force is generally in the direction of travel). Each travel segment may have a different trigger pull weight (i.e., level of force). This aids a user in determining by feel where a trigger is located within its general travel from a resting position through an engagement or firing position to a post-firing position, back to a reset point, and finally back to a resting position.

Users of firearms, and handguns in particular, often have differing preferences for the feel of a trigger. The feel can be affected by altering one, some, or all of the travel distances and/or altering one, some, or all of the pull weights associated with each travel segment. A trend exists towards a preference for a shorter pre-travel distance. A similar trend exists with respect to shorter over-travel and reset travel distances. These travel distances, alone or in combination, can affect how a user grips the firearm and how their grip can change throughout the travel of the trigger, which can ultimately affect accuracy.

Similarly, a trend exists toward a preference for lowered maximum trigger pull weights. Variations on factors affecting trigger pull weight are possible, but implementing certain variations can often affect other performance aspects of a firearm given current configurations.

SUMMARY OF THE INVENTION

Several embodiments of the invention advantageously address the needs above as well as other needs by providing a trigger bar for a firearm comprising: a generally longitudinal body having a front end and a rear end wherein the front end is configured to couple to a trigger of the firearm; an arm extending laterally outward from a portion of the body proximate to the rear end and including: a sear activation tab configured to engage a portion of a sear of the firearm; and a drop safety lifter tab configured to engage a portion of a drop safety lifter of the firearm, whereby the trigger bar is configured to engage the sear and a drop safety of the firearm when the trigger is pulled, whereby the firearm is fired, wherein the sear activation tab and the drop safety lifter tab are configured to result in a total rearward trigger travel distance of less than 0.14 inches prior to firing of the firearm.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
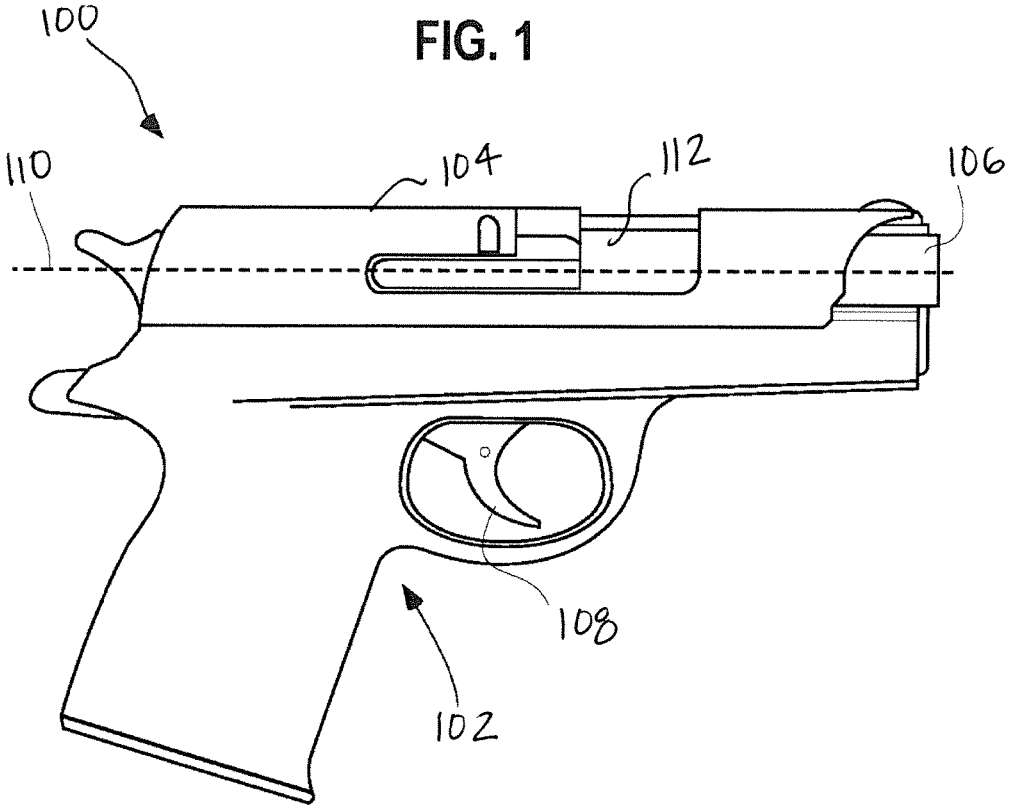
FIG. 1 is a side elevational view of a firearm in the locked position, in accordance with an embodiment of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Moreover, many references are made throughout this specification to approximate values and ranges. The terms "approximate" or "about" as used herein are meant simply to account for various tolerances and reasonable variances as may exist in manufacturing and testing procedures as are readily understood by those having skill in the art. For example, reference to an approximate value may inherently include a tolerance or variance of 0.10%, 1%, 5%, 10%, or anything in between, as would be deemed appropriate by one having skill in the relevant art with regard to the specific item or concept to which the value or range pertains.

In the context of this description, directions are oriented with respect to a direction along the firing axis towards the exit portion of a barrel of the firearm being defined as a "frontwards" or "forward" direction. "Rearwards" is understood to mean along the longitudinal axis towards a magazine or grip portion of the firearm. Left and right are defined with respect to looking in the forward direction.

Figure 2:
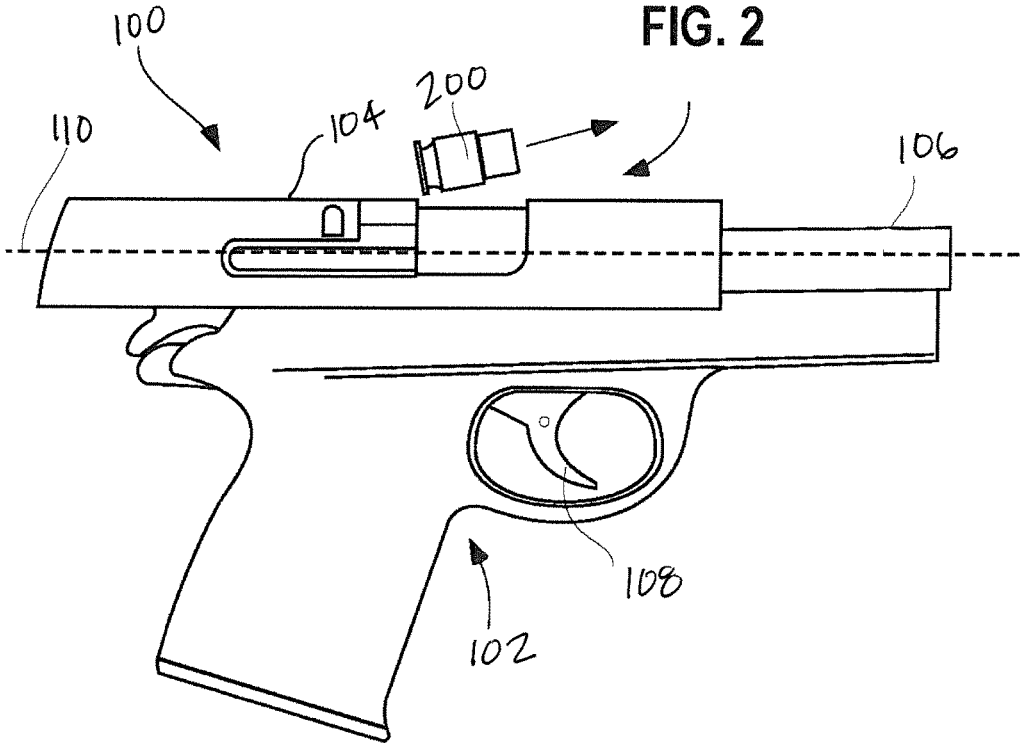
FIG. 2 is a side elevational view of the firearm in the fully recoiled position, in accordance with an embodiment of the present invention.

Referring first to FIGS. 1 and 2, side elevational views of an assembled firearm 100 is illustrated in accordance with various embodiments. FIG. 1 shows the firearm 100 in the locked position, and FIG. 2 shows the firearm 100 in the fully recoiled position.

By one approach, the firearm 100 is a semiautomatic handgun or pistol, though the teachings disclosed herein may be applied to any type of firearm 100. Shown are a frame 102, a slide 104, a barrel 106, a trigger 108, a longitudinal firing axis 110, and a cartridge 200. The barrel 106 is disposed at a front aperture of the slide 104 and is cooperatively linked therewith, and, together with the slide 104, defines the longitudinal firing axis 110. The barrel 106 has a rearward end adapted for receiving the cartridge 200 fed from a magazine. The trigger 108 is pivotally mounted to the frame 102 to actuate a firing mechanism to fire the firearm 100. A portion of the firing mechanism 300 is shown below in FIG. 3. Often, the frame 102 is fabricated of a high-impact polymer material, metal, a combination of polymer and metal, or the like. The firing mechanism or means is provided for, at least in part, discharging a round of ammunition upon actuation of the trigger 108.

The slide 104 is fitted to opposingly-positioned rails of the frame 102 to effect the reciprocal movement of the slide 104 along the longitudinal firing axis 110. The rails extend along the underside of the slide 104 in the longitudinal direction and are cooperative with the frame 102 to allow the cycling of the slide 104 between forward (battery) and rearward (retired) positions. The slide 104 further includes a breech, an ejection port 112, and an ejection mechanism that provides for the ejection of the cartridge 200 through the ejection port 112 upon firing the firearm 100 or upon manual cycling of the slide 104.

The cooperation of the frame 102, the slide 104, the barrel 106, and the firing mechanism during the loading, firing of a cartridge, and ejecting of the spent cartridge casing for the firearm 100 of the present type can be understood by referring to U.S. Pat. No. 7,617,628 (Curry) and U.S. Pat. No. 6,993,864 (O'Clair et al.), the entirety of which are incorporated herein by reference.

Figure 3:
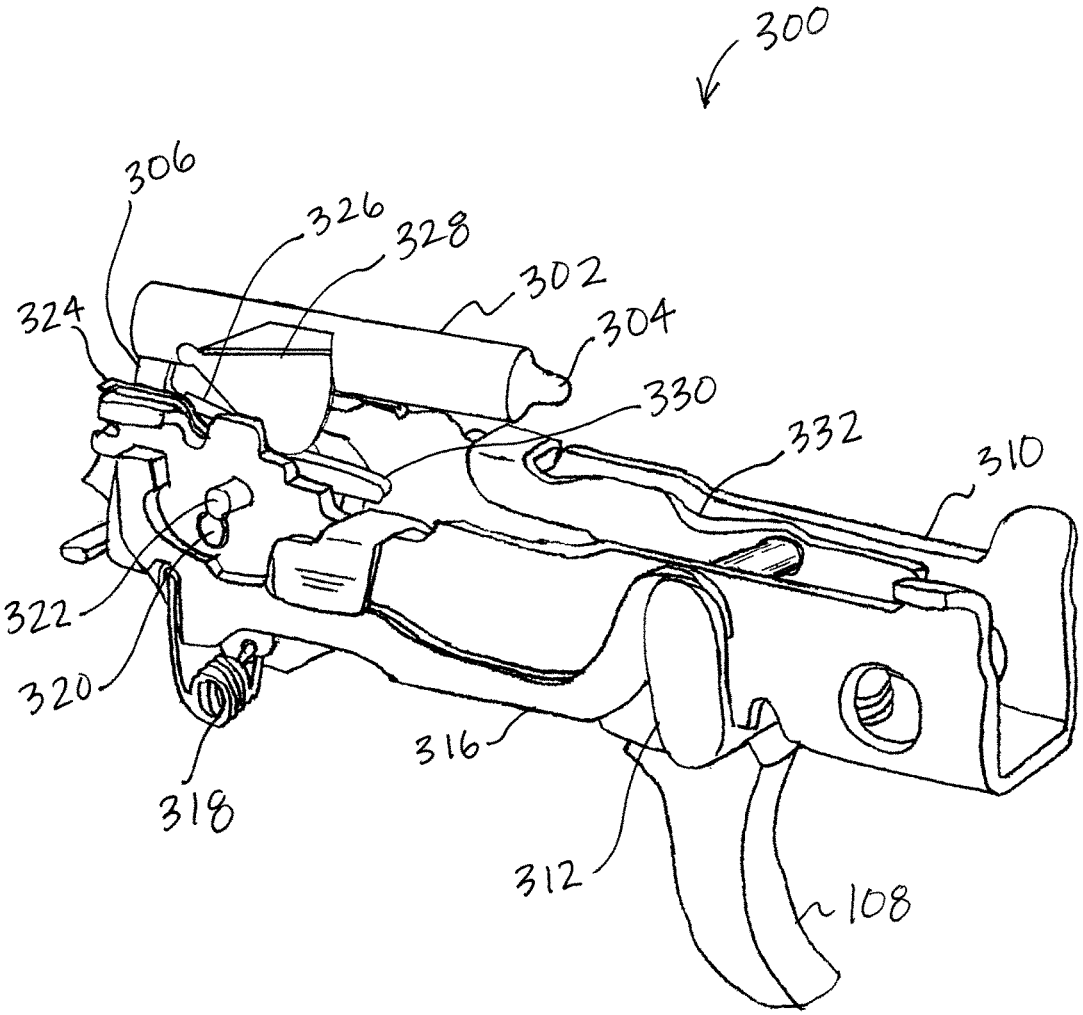
FIG. 3 is a front perspective view of a firing mechanism for the firearm in accordance with an embodiment of the present invention.

Referring next to FIG. 3, a front perspective view of the portion of the firing mechanism 300 for the firearm 100 is illustrated in accordance with at least one embodiment. Shown are the trigger 108, a striker 302, a firing pin portion 304, a depending leg 306, a firing mechanism frame 310, a trigger link 312, a trigger bar 316, a trigger bar spring 318, a safety lever pin 320, a sear pivot pin 322, a sear housing 324, a sear 326, a drop safety 328, a drop safety lifter 330, and a slide catch lever 332.

The firing mechanism frame 310 is mounted within the frame 102. The firing mechanism frame 310 provides a support framework for most of the components shown in FIG. 3, including the trigger 108, the trigger link 312, the trigger bar 316, the sear housing 324 (which includes a disengagement surface, not shown, that forces the trigger bar down as the trigger bar travels forward), and the sear 326. The trigger link 312, while herein referred to separately from the trigger 108 portion for clarity, is typically integrally formed with the trigger 108 and as known in the art the term "trigger" usually refers to the trigger-trigger link element. The trigger 108 is pivotally coupled to the trigger bar 316 via the trigger link 312. The sear assembly 208 is operably engagable with a trigger assembly 210 that includes the trigger 108 and trigger bar 316. Upon operation of the firearm 100 (via movement of the trigger 108), a surface of the depending leg 306 is selectively engaged by the sear assembly 208.

The drop safety 328 includes an interference tab that prohibits the striker from going forward. During the firing sequence of the firearm 100, the trigger bar 316 engages the sear 326 and the drop safety lifter 330, as described further below. The drop safety lifter 330 is rotated upwards and then engages the drop safety 328. Further movement of the trigger 108 caused the drop safety lifter 330 to lift the drop safety 328 out of the way, whereby the interference tab no longer prevents the striker from moving forward. As the trigger is moved further rearward the sear 326 is moved sufficiently that it releases the depending leg 306 of the striker 302 and the firearm 100 is fired.

Figure 4:
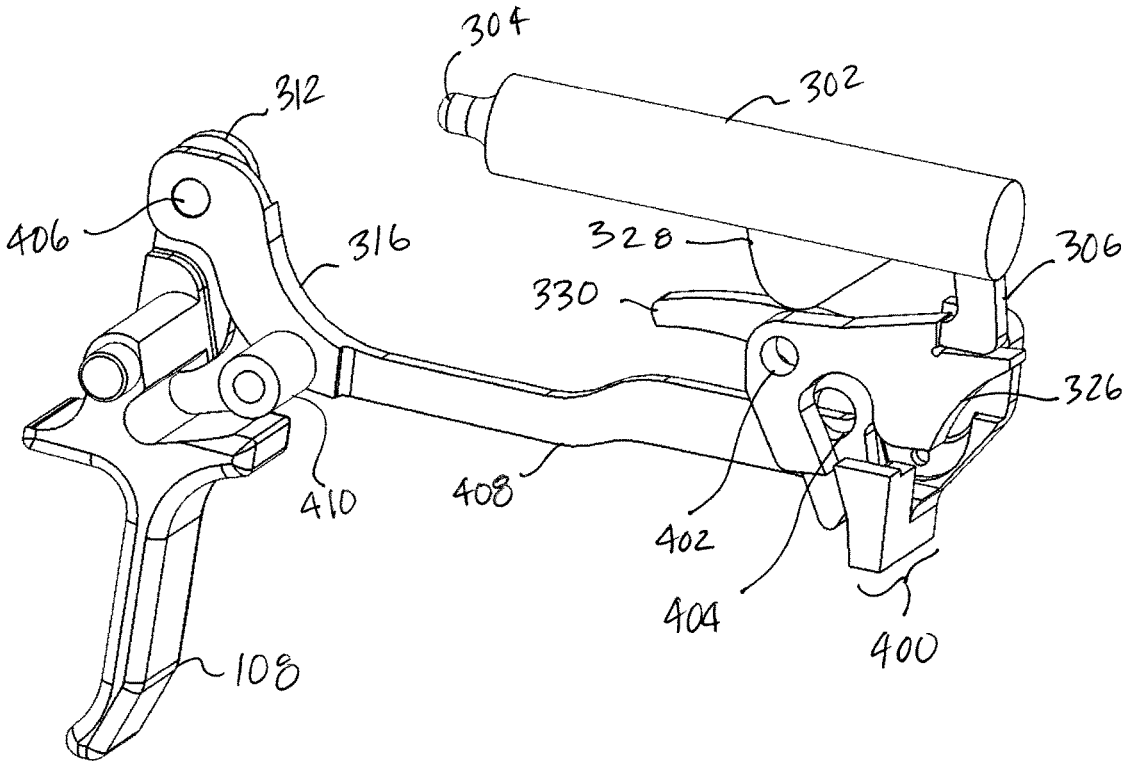
FIG. 4 is a rear perspective of a portion of the firing mechanism of FIG. 5.
Figure 5:
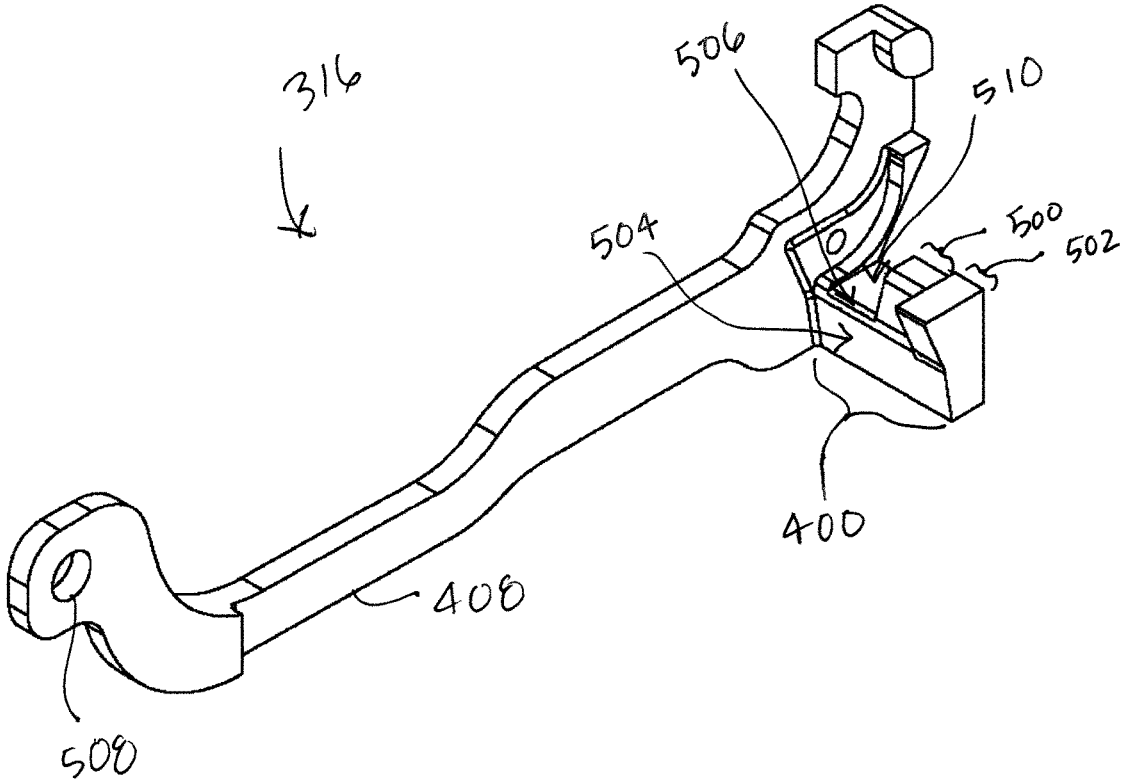
FIG. 5 is a front perspective view of a trigger bar of the firing mechanism in accordance with an embodiment of the present invention.

Referring next to FIG. 4, a rear perspective view of an assembly of the firing mechanism portion 300 is shown in a pre-firing sequence position. Shown are the trigger 108, the trigger link 312, the trigger bar 316, the striker 302, the striker leg 306, the sear 326, the drop safety 328, the drop safety lifter 330, a trigger bar arm 400, a sear pivot hole 402, a safety lever hole 404, a trigger bar boss 406, a trigger bar body 408, and an over-travel stop 410.

As shown in FIG. 4, the trigger bar 316 is pivotally connected to the trigger 108 via the cylindrical trigger bar boss 406 at a front end of the trigger bar 316 connecting the trigger bar 316 to the trigger link 312. The trigger bar boss 406 is integral to the trigger link 312 and extends outwards from an inner face of the trigger link 312 proximate to the trigger bar 316. The trigger bar boss 406 is inserted in the trigger bar hole 508, whereby the trigger bar 316 is coupled to the trigger link 312 for rotational and translational movement. The trigger link 312 is rigidly coupled to the trigger 108. A rear end of the trigger bar 316 includes the arm 400 extending laterally outward from a lower portion of the trigger bar 316. The arm 400 includes surfaces for engaging the sear 326 and the drop safety 328, and the disengagement surface of the sear housing 324, as described further below. The trigger bar comprises 4140 steel or other suitable material.

An over-travel pin (not shown) extends laterally inward from an inside face of the firing mechanism frame 310. The tubular over-travel stop 410 is configured to fit over the over-travel pin and is held in place by the firing mechanism frame 310. The over-travel stop 410 in one embodiment as an inside diameter for approximately 0.003" larger than the over-travel pin. The over-travel stop 410 is stationary with respect to the firing mechanism frame 310 and is configured to stop the rearward movement of the trigger 108 after the trigger 108 has traveled a certain distance rearward after firing (the over-travel distance 916 as described in FIG. 9). In the present embodiment, the over-travel stop 410 is configured and located relative to the trigger 108 such that the over-travel distance 916 is reduced from the factory firearm 100 which does not include the over-travel stop 410. The increased diameter of the over-travel stop 410 compared to the factory over-travel pin reduces the over-travel distance of the trigger 108.

The sear 326 rotates about and is supported by the sear pivot pin 322 in the sear pivot hole 402. The drop safety lifter 330 rotates about and is supported by the safety lever pin 320 in the safety lever hole 404.

The notch in the rear portion of the sear 326 restrains the striker 302 in the rearward (ready to fire) position. The arm 400 of the trigger bar 316 is configured to engage and move the drop safety lifter 330 and the sear 326 when the trigger is moved rearward.

In operation, before the firing procedure the trigger bar 316 may be biased forward in a rearward longitudinal direction by trigger bar spring 318 or the like. When the trigger 108 is pulled in a rearward direction, due to the trigger link 312 connection the trigger bar 316 is moved generally forward, whereby the arm 400 moves generally forward, engaging first the drop safety lifter 330 and then the sear 326. As the trigger 108 continues to be pulled, eventually the drop safety 328 and the sear 326 reach the position where the leg 306 of the striker 302 is released from the sear 326, whereby the firearm 100 is fired.

Referring next to FIGS. 5-8, an exemplary trigger bar 316 is shown in on embodiment of the present invention. Shown are the arm 400, the body 408, a drop safety lifter tab 500, a sear activation tab 502, a lower surface 504, a cam surface 506, a trigger bar hole 508, a cam portion upper surface 510, a sear activation tab upper surface 512, a drop safety lifter engagement surface 600, a sear engagement surface 702, and a cam portion 800.

The trigger bar 316 comprises the longitudinal body 408 with a front end of the body 408 including the trigger bar hole 508 configured to couple to the trigger bar boss 406 as shown in FIG. 4, whereby the trigger bar 316 is pivotally coupled to the trigger link 312. The body 408 is configured to extend down the side of the firing mechanism frame 310, as shown in FIG. 3. A rear end of the trigger bar 316 includes the arm 400, which extends perpendicularly outward from the body 408 under a rear portion of the firing mechanism frame 310 in order to engage the other portions of the firing mechanism 300 during the firing sequence. The embodiment shown is configured to be fit within and operational for a P320 series of firearms manufactured by Sig Sauer, including 9 mm, .357, .40 and .45 firearms. In use, a factory trigger bar of the P320 firearm is removed and replaced with the trigger bar 316. In some cases, the trigger 108 is replaced along with the trigger bar 316, although replacement of the trigger 108 is not required for the improved trigger travel resulting from the replacement of the trigger bar 316.

Figure 6:
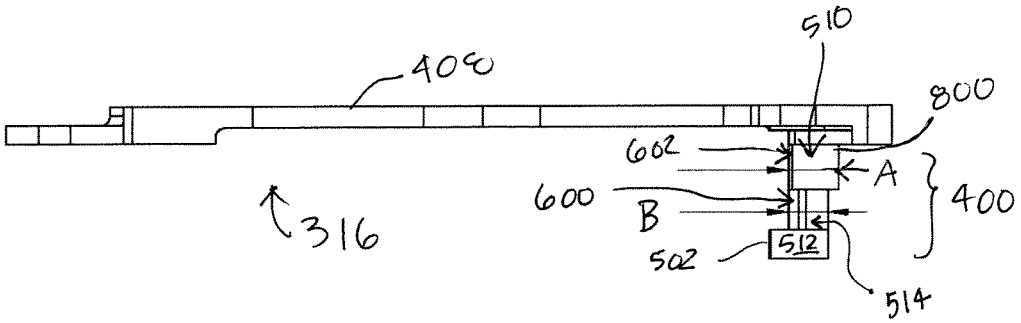
FIG. 6 is a top view of the trigger bar.
Figure 7:
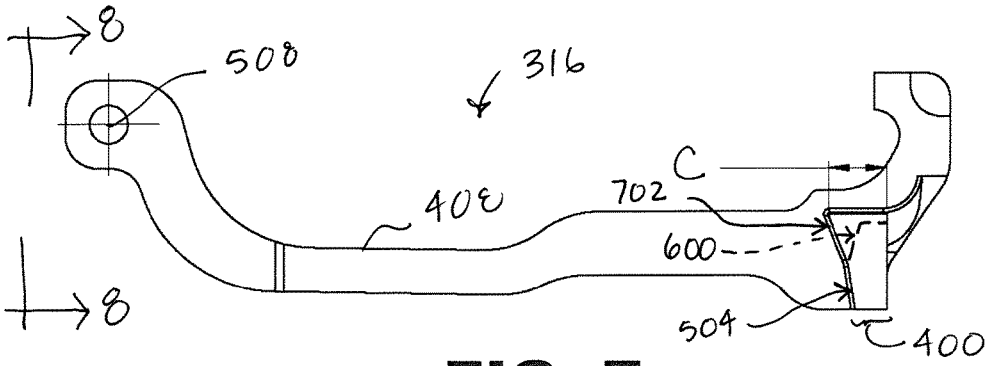
FIG. 7 is a side elevational view of the trigger bar.
Figure 8:
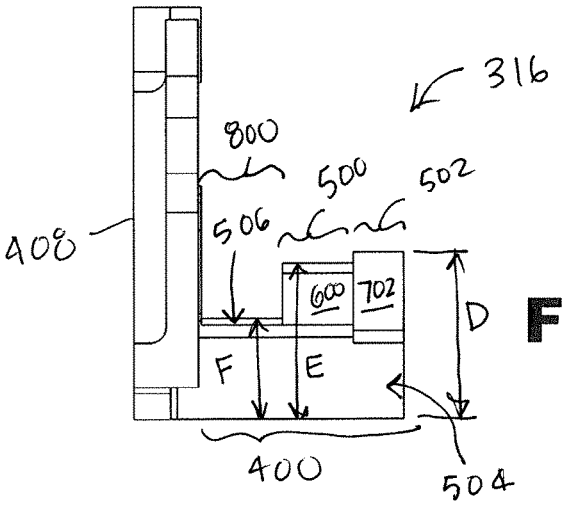
FIG. 8 is a front elevational view of the trigger bar.

The arm 400 is generally rectangular, with a bottom surface aligned with a bottom surface of the body 408 at the location of the arm 400. The profile of an upper portion of the arm 400 varies, and is generally divided into three separate segments along the arm 400. Proximate to the body 408 is the cam portion 800, which includes the generally horizontal cam portion upper surface 510. The cam portion 800 includes a chamfer on a forward edge of the cam portion upper surface 510, which forms the angled cam surface 602. A front-to-back width of the cam portion 800, indicated by "A" in FIG. 6, is approximately 0.125 inches. A side-to-side width of the cam portion upper surface 510 (i.e. perpendicular to the dimension A) is approximately 0.145 inches. A height of the arm 400 at the cam portion 800, indicated by "F" in FIG. 8, is approximately 0.17". The cam portion 800 is configured to be engaged by a cam of the frame that interacts with the cam portion 800 during the firing sequence, eventually causing the sear to disconnect from the sear activation tab 502, allowing the sear 326 to reset.

A free end portion of the arm 400, i.e. the portion distal to the body 408, includes the sear activation tab 502. A height of the arm 400 at the sear activation tab 502, indicated by "D" in FIG. 8, is approximately 0.29", with the bottom of the cam portion 800 and the sear activation tab 502 aligned, i.e. the generally horizontal sear activation tab surface 512 is higher than the cam portion upper surface 510. The portion of the sear activation tab 502 extending upward above the cam surface 506 includes the forward-facing sear engagement surface 702. The sear engagement surface 702 is angled forward such that the front-to-back width of the sear activation tab 502 is larger at the sear activation tab upper surface 512 than at the lower surface 504 of the arm 400. In the present embodiment, the sear activation tab upper surface 512 has a front-to-back width of approximately 0.184", as indicated by the dimension "C" in FIG. 7. The sear engagement surface 702 angle is approximately 22.5 degrees forward of vertical. The upper portion of the sear activation tab 502, in particular the sear engagement surface 702, is angled forward so that the trigger bar contacts the sear sooner in the firing sequence, shortening the length of the firing sequence. The firing sequence is also slightly shortened by the sear activation tab 502 contacting the sear 326 at a location on the sear 326 that is closer to the pivot point of the sear 326 (sear pivot hole 402). Activation of the sear 326 closer to the pivot point increases the rotation of the sear 326 about the pivot point per trigger movement, decreasing the length of trigger movement needed to rotate the sear 326.

Interposed between the cam portion 800 and the sear activation tab 502 is the drop safety lifter tab 500. The drop safety lifter tab 500 has a height between that of the cam portion 800 and the sear activation tab 502, as indicated by the dimension "E" shown in FIG. 8. In the present embodiment, the height is approximately 0.27", whereby a difference in height between the drop safety lifter tab upper surface 514 and sear activation tab upper surface 512 is approximately 0.020". In some embodiment, the difference in height is less than 0.025 inches. The portion of the drop safety lifter tab 500 extending upward above the cam portion 800 includes the forward-facing drop safety lifter engagement surface 600. The drop safety lifter engagement surface 600 is angled rearward such that the front-rear width of the drop safety lifter tab 500 is narrower at the top of the drop safety lifter tab 500 than at the bottom. In the present embodiment, the width of the drop safety lifter tab upper surface 514 is approximately 0.085" and the angle of the drop safety lifter engagement surface 600 is approximately 18.5 degrees.

The trigger bar 316 is configured to replace the factory trigger bar provided with the Sig Sauer P320 firearm and as such is configured to provide the required connections and operative characteristics of the original factory trigger bar. The geometry of the surfaces that interact with other elements of the firing mechanism 300, i.e. the cam surface 506, the drop safety lifter engagement surface 600, and the sear engagement surface 702 are configured to reduce a pre-engagement travel distance 912 and an over-travel travel distance 916, and condense an engagement travel distance 914, as described further below in FIG. 9.

Figure 9:
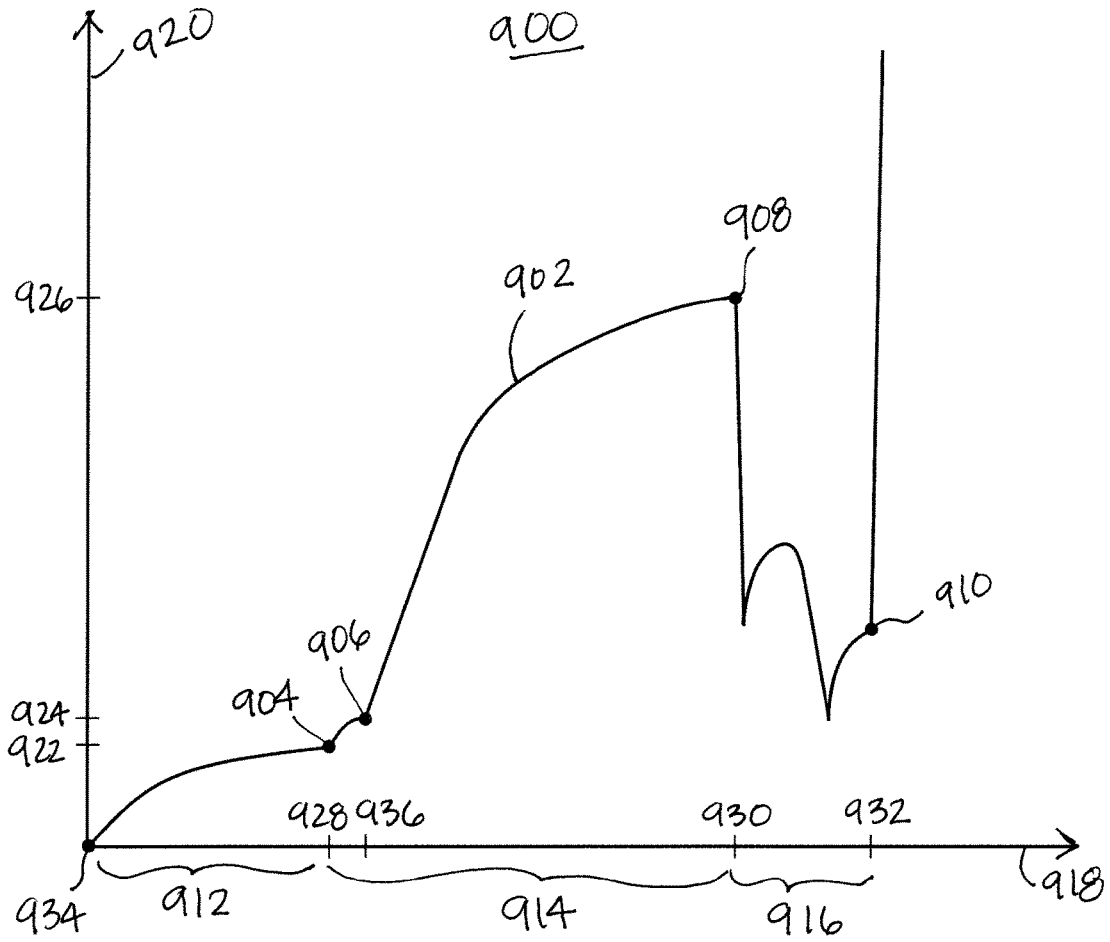
FIG. 9 is a graph showing a trigger pull weight profile for a firearm including the trigger bar of FIGS. 5-8.

Referring next to FIG. 9, a graph 900 showing a trigger pull weight profile 902 for a firearm 100 including the trigger bar 316 shown in FIGS. 3-8 is shown. Shown are a drop safety lifter engagement point 904, a sear engagement point 906, a sear release point 908, a trigger stop point 910, the pre-engagement travel distance 912, the engagement travel distance 914, the over-travel travel distance 916, a trigger travel distance axis 918, a pull weight axis 920, a drop safety lifter engagement pull weight 922, a sear engagement pull weight 924, a sear release pull weight 926, a drop safety lifter engagement distance 928, a sear release distance 930, a trigger stop distance 932, and a trigger movement start point 934, and a sear engagement distance 936.

The trigger pull weight profile 902 shows the variation of the pull weight of the firearm 100 (as plotted with respect to the vertical pull weight axis 920) as the trigger 108 is pulled rearward (as plotted with respect to the horizontal trigger travel distance axis 918).

The trigger pull weight profile 902 starts at the trigger movement start point 934, which is at the origin of the graph 900, i.e. the trigger 108 has not moved rearward and no pull weight has been applied to the trigger 108.

As the user applies pressure to the trigger 108, moving the trigger bar 316 in the generally forward direction, the pull weight (along the pull weight axis 920) and the rearward travel distance (along the trigger travel distance axis 918) increase along a curve until the drop safety lifter engagement point 904 is reached after traveling the pre-engagement travel distance 912, which is approximately 0.045" in the present embodiment. At the drop safety lifter engagement point 904 the trigger bar 316 first contacts the drop safety lifter 330. At the drop safety lifter engagement point 904 the total rearward trigger travel distance is the drop safety lifter engagement distance 928, and the required pull weight at the drop safety lifter engagement point 904 is the drop safety lifter engagement pull weight 922. In the present embodiment, the drop safety lifter pull weight 922 is approximately 1.015 pounds. After the trigger bar 316 engages the drop safety lifter 330, as the trigger bar 316 continues to move rearward it rotates the drop safety lifter 330 upward which in turn rotates the drop safety 328 upward to ultimately be in a position to allow for firing of the firearm 100.

As the trigger 108 is continued to be pulled rearward by the user, the travel distance and the pull weight continue to increase, until a short distance after the drop safety lifter engagement point 904, the trigger bar 316 engages the sear 326 at the sear engagement point 906. The total trigger rearward travel distance at the sear engagement point 906 is the sear engagement distance 936, and the required pull weight is the sear engagement pull weight 924. In the present embodiment, the sear engagement distance 936 is approximately 0.054 inches, and the sear engagement pull weight 924 is approximately 1.32 pounds.

After the engagement of the sear 326, the trigger pull weight increases sharply, then levels off until the sear release point 908. At the sear release point 908, the forward movement of the trigger bar 316 (as moved by the trigger 108) has rotated the drop safety 328 up and the sear 326 has been rotated in a clockwise direction until the depending leg 306 of the striker 302 loses contact with the sear 326, resulting in the firing of the firearm 100. The total trigger travel distance at the sear release point 908 is the sear release distance 930, and the trigger pull weight at the sear release point 908 is the sear release pull weight 926. In the present embodiment, the sear release distance 930 is approximately 0.13 inches, and the sear release pull weight 926, i.e. the maximum trigger pull weight prior to firing, is approximately 5.698 pounds. The rearward trigger travel distance between the first engagement of the trigger bar 316 with a portion of the firing assembly (i.e. the drop safety lifter engagement point 904), and the sear release point 908, is the engagement travel distance 914, which in the present embodiment is approximately 0.086 inches. In one embodiment, the trigger bar 316 of the present invention results in a total rearward movement before firing (i.e. the pre-engagement travel distance 912 plus the engagement travel distance 914) of less than 0.14 inches.

After release of the sear 326 and the firing of the firearm 100, the trigger continues to move rearward, and the trigger pull weight drops. At the trigger stop point 910 (corresponding to the trigger stop distance 932), the rearward movement of the trigger 108 is stopped, generally by contact with the over-travel stop 410. The rearward movement of the trigger 108 between the sear release point 908 and the trigger stop point 910 is the over-travel travel distance 916. In the present embodiment, the over-travel stop 410 is configured to interfere with the trigger 108 after firing, thereby stopping the rearward movement of the trigger 108 and limiting the over-travel travel distance 916 to less than 0.04 inches. In some embodiments the over-travel travel distance 916 is approximately 0.032 inches. A shorter over-travel travel distance 916 is advantageous as a shorter over-travel travel distance 916 lessens the distance the trigger 108 needs to travel to reset, resulting in less time between shots. A shorter over-travel travel distance 916 also prevents the firearm 100 from being disturbed while a bullet is still in the barrel 106.

Figure 10:
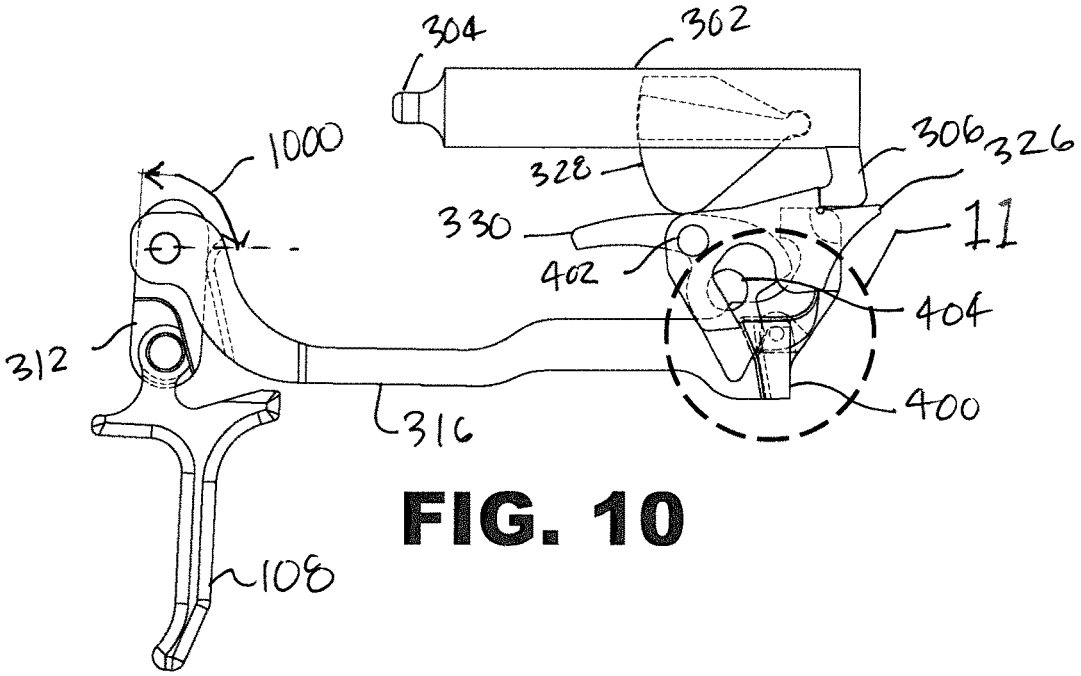
FIG. 10 is a side elevational view of the portion of the firing mechanism prior to starting the firing, sequence.
Figure 11:
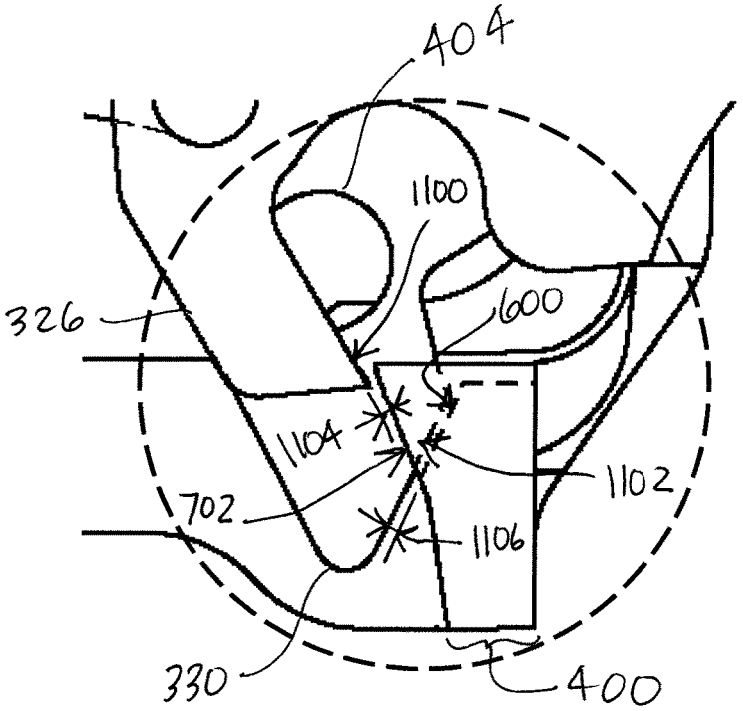
FIG. 11 is a detail view of FIG. 10.

Referring next to FIGS. 10 and 11, the portion of the firing mechanism of FIG. 4 is shown during a resting state of the firearm 100, i.e. prior to rearward movement of the trigger 108. Shown are the striker 302, the firing pin portion 304, the depending leg 306, the trigger 108, the trigger bar 316, the trigger link 312, the drop safety 328, the drop safety lifter 330, the sear 326, the trigger bar arm 400, the sear pivot hole 402, the safety lever hole 404, the drop safety lifter engagement surface 600, the sear engagement surface 702, a trigger bar boss angle 1000, trigger bar sear activation tab engagement surface 1100, a trigger bar drop safety tab engagement surface 1102, a sear clearance distance 1104, and a drop safety lifter clearance distance 1106.

As shown in FIGS. 10 and 11, during the resting state a front edge of the trigger bar boss 406 is rotated rearward at the angle of the trigger bar boss angle 1000, which for the present embodiment is approximately 86.49 degrees. The arm 400 of the trigger bar 316 is not in contact with the sear 326, as the sear engagement surface 702 of the trigger bar 316 is separated from the trigger bar sear activation tab engagement surface 1100 of the sear 326 by the sear clearance distance 1104. In the present embodiment, the sear activation tab 502 is configured such that at rest the sear clearance distance 1104 is approximately 0.02 inches.

The arm 400 of the trigger bar 316 is also not yet in contact with the drop safety lifter 330, as the drop safety lifter engagement surface 600 of the arm 400 is not is separated from the trigger bar drop safety tab engagement surface 1102 of the drop safety lifter 330 by the drop safety lifter clearance distance 1106. In the present embodiment, the drop safety lifter tab 500 is configured such that at rest the drop safety lifter clearance distance 1106 is approximately 0.01 inches.

An angle between horizontal and a front face of the trigger link 312 forms the trigger bar boss angle 1000. Before the firing sequence, the angle 1000 is approximately 86.49 degrees, i.e. the trigger link 312 is rotated slightly rearward with respect to the trigger connection.

The positions shown in FIGS. 10 and 11 correspond to the trigger movement start point 934 of the trigger pull weight profile 902 as previously shown in FIG. 9. As the user is just about to start pulling the trigger, there is no current movement of the firearm 100 and the pull weight is zero.

Figure 12:
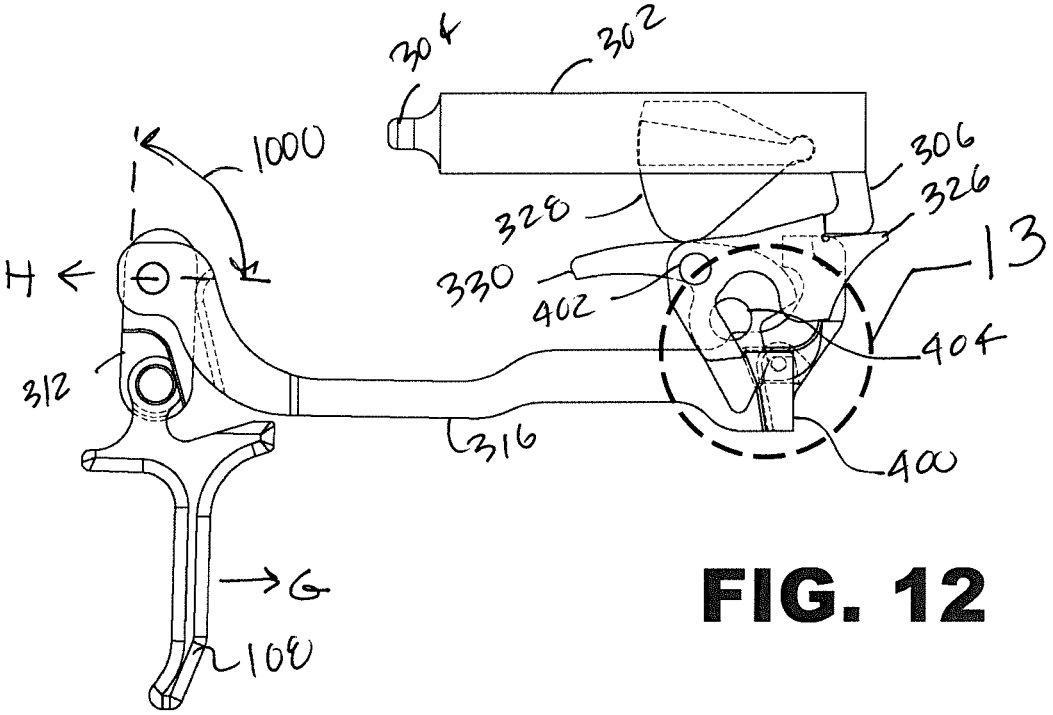
FIG. 12 is a side elevational view of the portion of the firing mechanism at drop safety lifter engagement.
Figure 13:
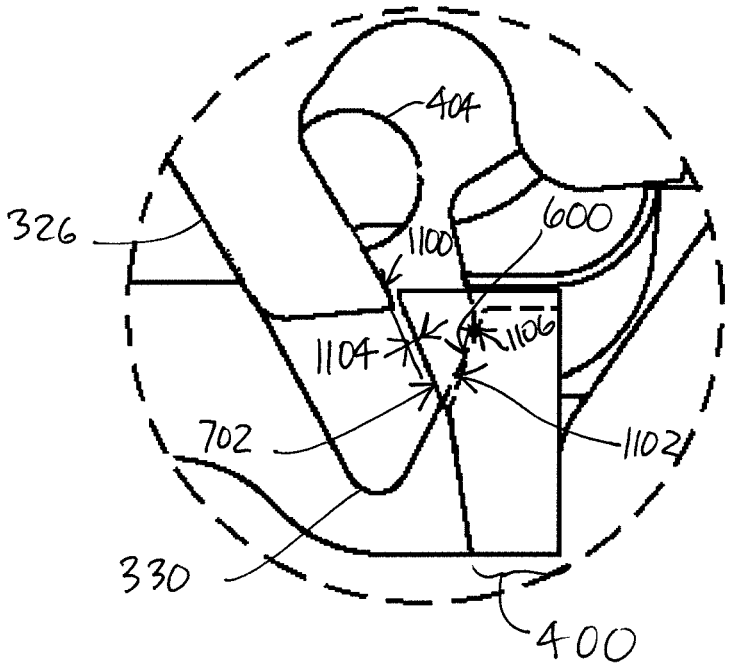
FIG. 13 is a detail view of FIG. 12.

Referring next to FIGS. 12 and 13, the portion of the firing mechanism of FIG. 4 is shown at contact of the trigger bar 316 with the drop safety lifter 330. Shown are the striker 302, the firing pin portion 304, the depending leg 306, the trigger 108, the trigger bar 316, the trigger link 312, the drop safety 328, the drop safety lifter 330, the sear 326, the trigger bar arm 400, the sear pivot hole 402, the safety lever hole 404, the drop safety lifter engagement surface 600, the sear engagement surface 702, the trigger bar boss angle 1000, trigger bar sear activation tab engagement surface 1100, the trigger bar drop safety tab engagement surface 1102, the sear clearance distance 1104, and the drop safety lifter clearance distance 1106.

The position of the portion of the firing mechanism corresponds to the drop safety lifter engagement point 904 of the trigger pull weight profile 902 of FIG. 9. The rearward movement of the trigger 108, as illustrated by the arrow "G", results in the generally forward movement of the trigger bar 316, as illustrated by the arrow "H". The forward movement has brought the arm 400 of the trigger bar 316 forward such that the drop safety lifter engagement surface 600 of the trigger bar arm 400 contacts the trigger bar drop safety tab engagement surface 1102 of the drop safety lifter 330, i.e. the drop safety lifter clearance distance 1106 is now zero.

Due to the geometry of the sear activation tab 502, there is still a gap between the trigger bar sear activation tab engagement surface 1100 and the sear engagement surface. In the present embodiment, at the drop safety lifter engagement point 904 the sear clearance distance 1104 is approximately 0.01".

Figure 14:
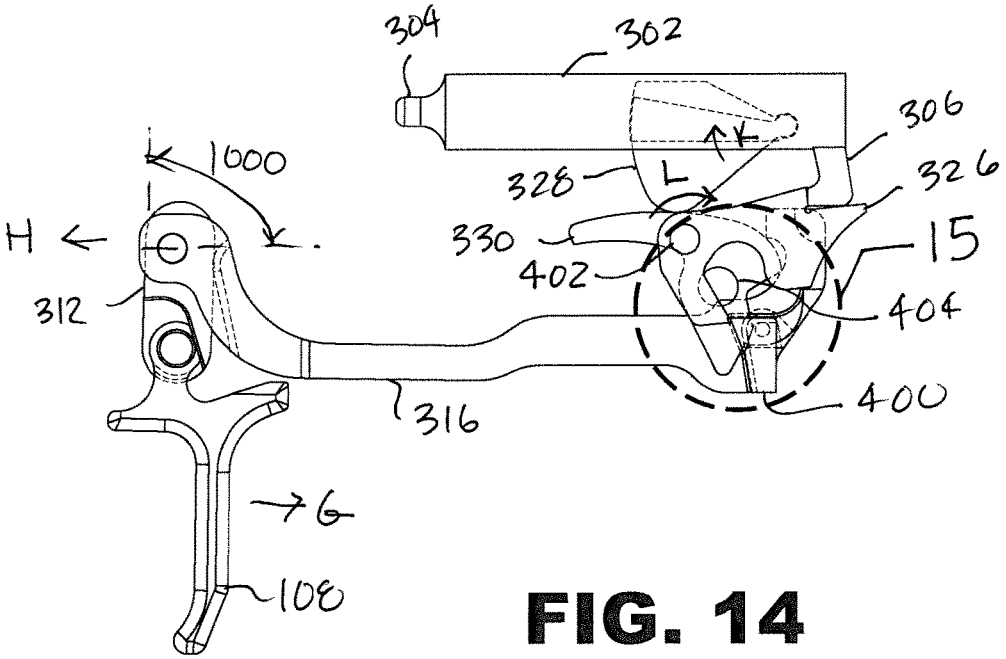
FIG. 14 is a side elevational view of the portion of the firing mechanism at sear engagement.
Figure 15:
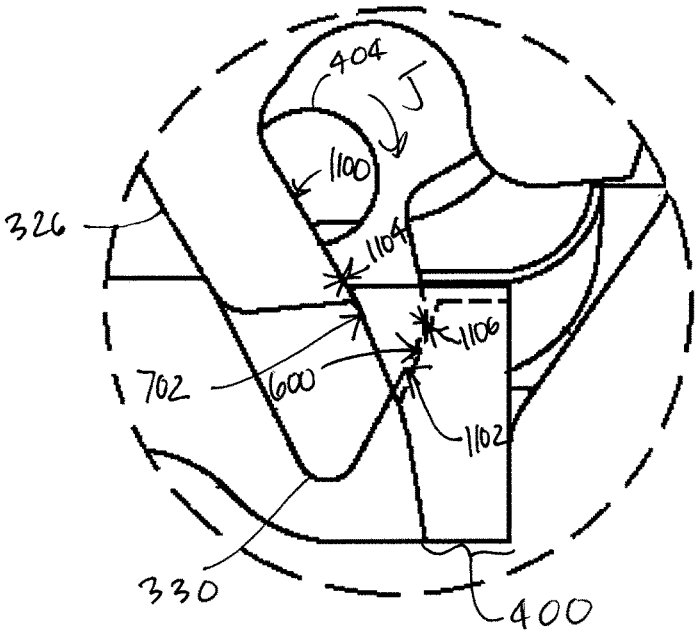
FIG. 15 is a detail view of FIG. 14.

Referring next to FIGS. 14 and 15, the portion of the firing mechanism of FIG. 4 is shown at contact of the trigger bar 316 with the sear 326. Shown are the striker 302, the firing pin portion 304, the depending leg 306, the trigger 108, the trigger bar 316, the trigger link 312, the drop safety 328, the drop safety lifter 330, the sear 326, the trigger bar arm 400, the sear pivot hole 402, the safety lever hole 404, the drop safety lifter engagement surface 600, the sear engagement surface 702, the trigger bar boss angle 1000, trigger bar sear activation tab engagement surface 1100, the trigger bar drop safety tab engagement surface 1102, the sear clearance distance 1104, and the drop safety lifter clearance distance 1106.

As shown in FIGS. 14 and 15, the rearward movement G of the trigger 108 has moved the trigger bar farther forward ("H") such that the drop safety lifter tab 500 in now in contact with the sear 326. This position corresponds to the sear engagement point 906 of the trigger pull weight profile 902 of FIG. 9. The sear clearance distance 1104 is now zero.

Additionally, as the trigger bar 316 has moved forward, the continued contact between the trigger bar arm 400 and the drop safety lifter 330 has rotated the drop safety lifter 330 clockwise about the safety lever hole 404, as indicated by the directional arrow "J". As the drop safety lifter 330 rotates upward the drop safety lifter 330 contacts drop safety 328 and pushes the drop safety 328 upwards, as indicated by the directional arrow "K".

Also, as the trigger 108 continues to be moved rearward after the trigger bar 316 contacts the sear 326, the sear 326 is rotated clockwise about the sear pivot hole 402, as indicated by the directional arrow "L". As the sear is rotated, the upper portion of the sear 326 contacting the depending leg 306 of the striker is moved downward away from the depending leg 306.

Figure 16:
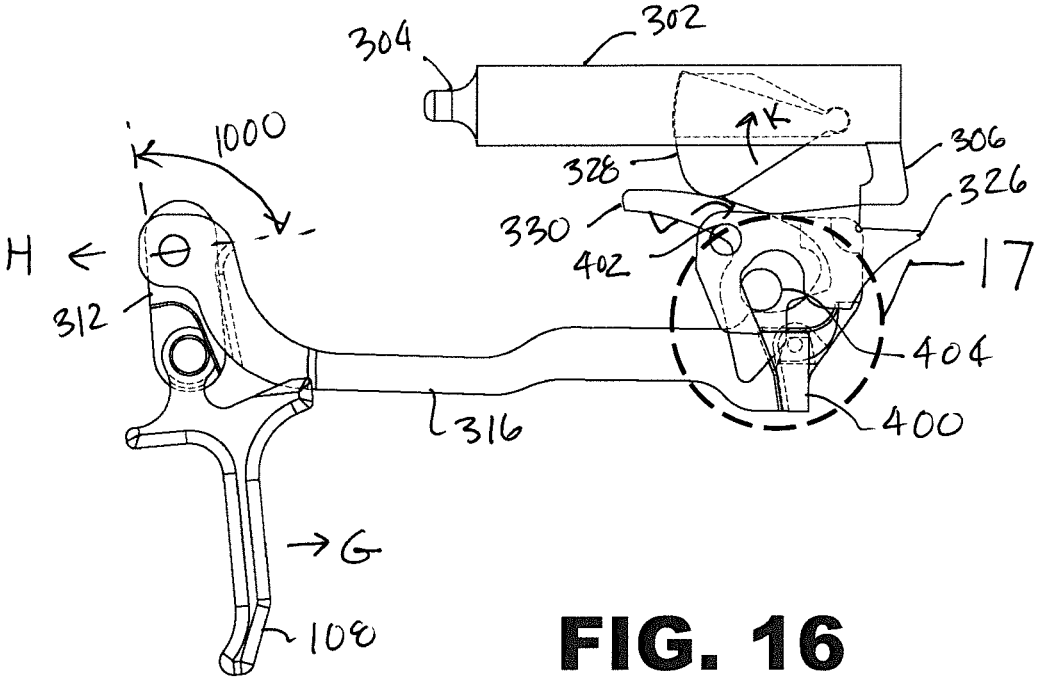
FIG. 16 is a side elevational view of the portion of the firing mechanism at striker release.
Figure 17:
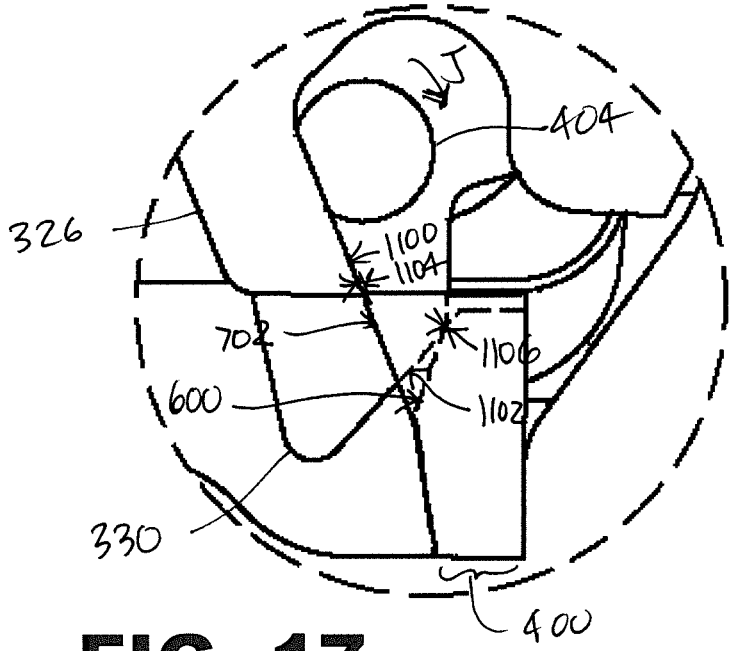
FIG. 17 is a detail view of FIG. 16.

Referring next to FIGS. 16 and 17, the portion of the firing mechanism of FIG. 4 is shown at the point when the striker is about to be released. Shown are the striker 302, the firing pin portion 304, the depending leg 306, the trigger 108, the trigger bar 316, the trigger link 312, the drop safety 328, the drop safety lifter 330, the sear 326, the trigger bar arm 400, the sear pivot hole 402, the safety lever hole 404, the drop safety lifter engagement surface 600, the sear engagement surface 702, the trigger bar boss angle 1000, trigger bar sear activation tab engagement surface 1100, the trigger bar drop safety tab engagement surface 1102, the sear clearance distance 1104, and the drop safety lifter clearance distance 1106.

The position shown in FIGS. 16 and 17 corresponds to the sear release point 908 of FIG. 9. As the trigger bar 316 moves forward, the sear activation tab 502 has rotated the portion of the sear 326 contacting the depending leg 306 down until the sear 326 is about to lose contact with the depending leg 306. When the depending leg 306 is released (just after the position as shown in FIGS. 16 and 17), as the depending leg 306 no longer provides resistance to moving, the sear activation tab 502 continues to move forward and downward until the sear activation tab 502 loses contact with the sear 326. The downward component of this motion is due to a cam of the sear housing 324 that contacts the cam surface 506, which in turn pushes the trigger bar 316 down as the trigger bar 316 is moved forwards.

Figure 18:
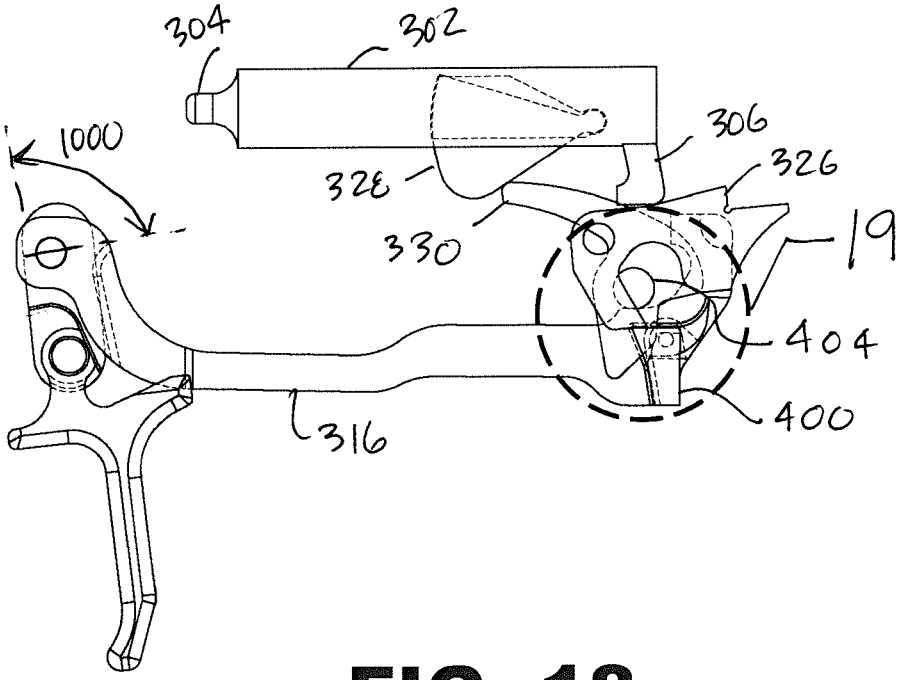
FIG. 18 is a side elevational view of the portion of the firing mechanism at a point after firing.
Figure 19:
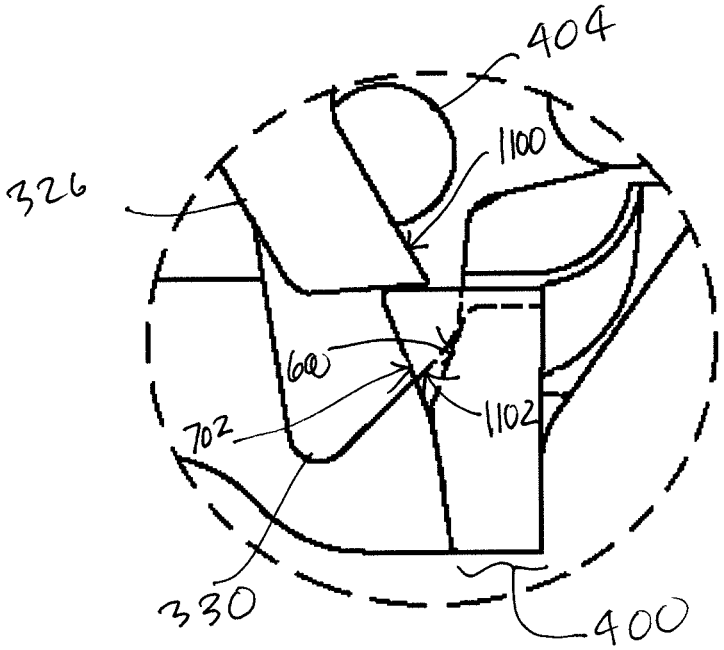
FIG. 19 is a detail view of FIG. 18

Referring next to FIGS. 18 and 19, the portion of the firing mechanism 300 of FIG. 4 is shown at the point post-striker release when the trigger 108 movement has stopped. Shown are the striker 302, the firing pin portion 304, the depending leg 306, the trigger 108, the trigger bar 316, the trigger link 312, the drop safety 328, the drop safety lifter 330, the sear 326, the trigger bar arm 400, the sear pivot hole 402, the safety lever hole 404, the drop safety lifter engagement surface 600, the sear engagement surface 702, the trigger bar boss angle 1000, trigger bar sear activation tab engagement surface 1100, the trigger bar drop safety tab engagement surface 1102, the sear clearance distance 1104, and the drop safety lifter clearance distance 1106.

FIGS. 18 and 19 shown the position corresponding to the trigger stop point 910 of FIG. 9. The trigger 108 has rotated the trigger link 312 to the final angle 1000. In the present embodiment, the angle 1000 is approximately 95.7 degrees, i.e. the trigger link 312 is rotated forward of vertical. After the striker 302 is released, the sear 326 has been rotated upwards by sear springs (not shown), and is positioned to reengage the striker 302 after the slide 104 cycles.

The rotation of the sear 326 has rotated a lower portion of the sear 326 including the trigger bar sear activation tab engagement surface 1100 so that an underside of the lower portion of the sear 326 rests against a top surface of the sear activation tab 502. When the trigger 108 is returned to a forward position, the trigger bar 316 will "reset" behind the sear 326, ready to fire the firearm 100 once again when the trigger 108 is pulled. Due to the short over-travel travel distance 916 and engagement travel distance 914, the distance to reset the trigger bar 316 is also short.

While the invention herein disclosed has been described by means of specific embodiments, examples and applications thereof, numerous modifications and variations could be made thereto by those skilled in the art without departing from the scope of the invention set forth in the claims.

What is claimed is:

1. A trigger bar for a firearm comprising:

a generally longitudinal body having a front end and a rear end wherein the front end is configured to couple to a trigger of the firearm;

an arm extending laterally outward from a portion of the body proximate to the rear end and including:

a sear activation tab configured to engage a portion of a sear of the firearm; and a drop safety lifter tab configured to engage a portion of a drop safety lifter of the firearm, whereby the trigger bar is configured to engage the sear and a drop safety of the firearm when the trigger is pulled, whereby the firearm is fired, wherein the sear activation tab and the drop safety lifter tab are configured to result in a total rearward trigger travel distance of less than 0.14 inches prior to firing of the firearm.

2. The trigger bar for the firearm of claim 1, wherein the sear activation tab includes a generally forward-facing sear engagement surface for engaging the sear, and wherein the sear engagement surface is configured such that a gap of approximately 0.02" exists between the sear engagement surface and the sear when the firearm is in a resting position prior to firing.

3. The trigger bar for the firearm of claim 2, wherein the sear engagement surface is angled forward approximately 22.5 degrees.

4. The trigger bar for the firearm of claim 1, wherein the sear activation tab has a height of approximately 0.29 inches.

5. The trigger bar for the firearm of claim 1, wherein the sear activation tab is configured to engage the sear before the trigger has traveled rearward 0.06 inches.

6. The trigger bar for the firearm of claim 1, wherein a top surface of the sear activation tab has a front-to-rear width of approximately 0.18 inches.

7. The trigger bar for the firearm of claim 1, wherein the drop safety lifter tab includes a generally forward-facing drop safety lifter engagement surface for engaging the drop safety lifter, and wherein the drop safety lifter engagement surface is configured such that a gap of approximately 0.01" exists between the drop safety lifter engagement surface and the drop safety lifter when the firearm is in a resting position prior to firing.

8. The trigger bar for the firearm of claim 7, wherein the drop safety lifter engagement surface is angled rearward approximately 18.5 degrees.

9. The trigger bar for the firearm of claim 1, wherein the drop safety lifter tab has a height of at approximately 0.27 inches.

10. The trigger bar for the firearm of claim 1, wherein the drop safety lifter tab is configured to engage the drop safety lifter when the trigger has traveled rearward approximately 0.05 inches.

11. The trigger bar for the firearm of claim 1, wherein the trigger bar is configured for use in a firearm manufactured by Sig Sauer.

12. The trigger bar for the firearm of claim 11, wherein the trigger bar is configured for use in a P320 series firearm.

13. The trigger bar for the firearm of claim 11, wherein the firearm is one of a 9 mm, a .357, a .40 and a .45 firearm.

14. The trigger bar for the firearm of claim 1, wherein a trigger pull weight for the trigger at engagement of the sear activation tab with the sear is less than 1.4 pounds.

15. The trigger bar for the firearm of claim 1, wherein a trigger pull weight for the trigger at engagement of the drop safety lifter tab with the drop safety lifter is less than 1.02 pounds.

16. The trigger bar for the firearm of claim 1, wherein a trigger pull weight for the trigger when the sear is released is less than 5.7 pounds.

17. The trigger bar for the firearm of claim 1, wherein the sear activation tab and the drop safety lifter tab are configured such that when the trigger is pulled, at first contact between the drop safety lifter tab and the drop safety lifter, there is approximately 0.01" of clearance between the sear activation tab and the sear.

18. The trigger bar for the firearm of claim 1, the arm further including a cam portion proximate to the body and configured to be engaged during a firing sequence of the firearm.

19. The trigger bar for the firearm of claim 1, wherein a top surface of the sear activation tab is higher than a top surface of the drop safety lifter tab.

20. The trigger bar for the firearm of claim 19, wherein the difference in height is less than 0.025 inches.

* * * * *